US005094180A

United States Patent [19]

Salganik

[11] Patent Number: 5,094,180

[45] Date of Patent: Mar. 10, 1992

[54] APPARATUS FOR DYNAMICALLY CHANGING STITCH LENGTH IN A DOUBLE LOCK STITCH SEWING MACHINE

[75] Inventor: Felix Salganik, Brooklyn, N.Y.

[73] Assignee: C & W Sewing Machine Attachment Co., Inc., Brooklyn, N.Y.

[21] Appl. No.: 635,994

[22] Filed: Dec. 26, 1990

[51] Int. Cl.[5] ..... D05B 27/22

[52] U.S. Cl. ..... 112/310; 112/315

[58] Field of Search ..... 112/165, 167, 197, 220, 112/221, 310, 315, 321, 443, 453

[56] References Cited

U.S. PATENT DOCUMENTS

| | | | |
|---|---|---|---|
| 3,521,585 | 7/1970 | Rouha | 112/310 |
| 3,687,096 | 8/1972 | Smith | 112/310 |
| 3,970,018 | 7/1976 | Hager | 112/310 |
| 4,619,214 | 10/1986 | Baruffa et al. | 112/315 X |
| 4,643,113 | 2/1987 | Schiudde et al. | 112/315 X |
| 4,781,134 | 11/1988 | Horie | 112/453 X |

FOREIGN PATENT DOCUMENTS

| | | | |
|---|---|---|---|
| 688957 | 3/1953 | United Kingdom | 112/210 |

*Primary Examiner*—Werner H. Schroeder
*Assistant Examiner*—Paul C. Lewis
*Attorney, Agent, or Firm*—Paul C. Scifo

[57] ABSTRACT

Apparatus for changing the stitch length of double lock stitch sewing machine while the machine is in operation. The apparatus including a first transmission having a variable transmission ratio that can be connected to the machine needle rocking assembly, and a second transmission having a variable transmission ration that can be connected to the machine feed dog assembly. Additionally, the apparatus includes an actuator connected to the first and second transmission that may be activated by a machine operator for synchronously changing the transmission ratio of the first and second transmission to effect change in the machine stitch. Both the first and second transmission include input and output lever elements for connecting the respective transmission to the machine needle rocking assembly and feed dog assembly, and a movable coupling assembly for connecting the input and output elements of the respective transmission together to facilitate change of the transmission ratio on movement of the respective coupling assembly by the apparatus actuator.

18 Claims, 4 Drawing Sheets

APPARATUS FOR DYNAMICALLY CHANGING STITCH LENGTH IN A DOUBLE LOCK STITCH SEWING MACHINE

FIELD OF INVENTION

This invention concerns apparatus for adjusting the stitch length of a double lock stitch sewing machine during operation. As used herein, the term "double lock stitch" refers to the federal specification type 401 stitch that features an upper or needle thread and a lower or locking thread, as distinguished from the type 101 "chain stitch" that utilizes a single thread. More specifically, the apparatus includes a first, variable ratio transmission adapted to be connected to the drive train of the machine needle rocker mechanism; a second variable ratio transmission adapted to be connected to the drive train of the machine feed dog mechanism; and an actuator coupled to the first and second transmissions for synchronously changing the transmission ratios of the first and second transmission to effect a change in stitch length as desired during machine operation.

BACKGROUND OF THE INVENTION

The commercial sewing industry has found double lock stitch sewing machines attractive for work that requires continuous or long duration machine operation. For example, in the making of automobile upholstery components, a double lock stitch machine can be run continuously as successive blanks of upholstery elements are fed to the machine for creating such features as the upholstery rolls. Because double lock stitch machines use large thread spools instead of the limited capacity bobbins required by lock stitch; i e., federal specification 301 type stitch, machines, the double lock stitch machines can be operated for long periods since interruption for replacement of the thread supply is significantly reduced.

Certain problems, however, do exist with double lock stitch sewing. Due to the intertwined nature of a double lock stitch, it has a tendency to unravel at the end of a seam, or length of stitching when the thread chain is cut and the work removed from the machine. The effect is to create an unsightly and potentially defective seam or line of stitching. Further, this problem becomes more severe as the length of the double lock stitch is increased; i.e., decreased stitch density, as for example, in automobile upholstery work.

In the past a number of approaches have been proposed to reduce the severity of this problem. For example, it has been proposed to extend the seam or stitching past the end of the fabric so as to form a "tail" to thereby reduce the chance unraveling will progress to the sewn fabric. This approach, however, is wasteful of thread and tends to create unsightly finished products having treads dangling from them. Additionally, the tail is susceptible to being caught and pulled raising the possibility of opening the seam or stitching. While it has been proposed to sew the tail back into the fabric, or back stitch the seam for a prescribed length, these approaches are likewise undesirable because they complicate production with extra steps and can require use of specialized machines or at least specialized machine attachments.

It has been suggested that a more desirable solution to the problem of unraveling could be provided if stitch length were changed during operation. Specifically, it has been proposed to make the double lock stitch more dense; i.e., decrease the stitch length, at the end of a seam or line of stitching. It has been found that due to the nature of the double lock stitch, the tendency for unraveling is substantially reduced if length is reduced; i.e., made more dense. It is believed that the decreased spacing between the locking portion of the stitch in a denser stitch reduces the ability of the thread to undo itself and release the stitch locks.

But, the ability to change stitch length during operation requires specialized double lock stitch sewing machines. As described in U.S. Pat. No. 4,643,113, issued Feb. 17, 1987 to Schrudde et al. and U.S. Pat. No. 3,742,880 issued July 3, 1973 to Franz, double lock stitch machines can be designed having mechanisms that permit stitch length to be manually adjusted without need for interrupting machine operation.

However, in conventional double lock stitch machines such as the Singer® 300W type machines widely used in industrial sewing today, stitch length can not be changed during machine operation. Rather, in such machines, adjustable eccentrics located within the machine at the arm and main drive shafts are required to be manipulated to change stitch length. As a result, it is not possible to change stitch length in such machines without stopping the machine and, thus interrupting production, a commercially undesirable procedure.

Accordingly, it is an objective of this invention to provide apparatus that may be used in double lock stitch sewing machines lacking dynamic stitch length adjustability for enabling the length of the machine stitch to be changed during operation.

It is a further object of this invention to provide apparatus that may be used in double lock stitch sewing machines lacking dynamic stitch length adjustability for enabling the length of the machine stitch to be reduced during operation at least at the end of a seam or line of stitching.

It is a still further object of this invention to provide a double lock stitch sewing machine having a stitch length that may be changed during operation.

It is a yet a further object of this invention to provide a double lock stitch sewing machine having a stitch length that may be reduced during operation at least at end of a seam or length of stitching.

It is still another object of this invention to provide apparatus that may be retrofitted to double lock stitch machines lacking dynamic stitch length adjustability for enabling machine stitch length to be varied at will during operation.

SUMMARY OF THE INVENTION

The apparatus in accordance with this invention realizes the above and other objectives by utilizing a first transmission having a variable transmission ratio that may be inserted into the drive line of the machine needle rocker mechanism and a second transmission having a variable transmission ratio that may be inserted into the drive line of the machine feed dog mechanism. In addition, the apparatus in accordance with the invention includes an actuator connected to the first and second transmissions to synchronously change the transmission ratios of the first and second transmissions.

In preferred form, the first and second transmissions are lever mechanisms having input lever elements that may be connected into the respective machine drive lines to pick up machine action, and output lever elements that may be connected back to the respective machine drive lines. Additionally, each of the transmissions includes a coupling assembly that connects the input and output lever elements. Further, the coupling assemblies of each transmission includes a pivotally mounted member arranged so that it may be translated to vary the effective length of the input and output lever elements to thereby change the transmission ratio of each of the transmissions as the pivotally mounted member is translated.

In accordance with a preferred form of the invention, the apparatus actuator includes a first pneumatic piston located at the first transmission and a second pneumatic piston located at the second transmission. Still further, the actuator includes a pneumatic switch having a first position for coupling a pneumatic reservoir to a feed line that connects to a side of each of the pneumatic pistons, and a second position for coupling the pneumatic reservoir to another side of each of the pneumatic pistons.

Additionally, the first and second pneumatic pistons are respectively connected to the first and second transmissions so that when the actuator switch is in the first position, the pistons locate the respective transmission members of the first and second transmission in a first position corresponding to a first transmission ratio and a corresponding first machine stitch length, and when the pneumatic switch is in the second position, the pistons locate their respective transmission members in a second position corresponding to a second transmission ratio and a corresponding second machine stitch length.

In preferred form, the first position of the actuator switch provides a transmission ratio of 1:1 leaving the machine stitch length unaltered. In the actuator second position a transmission ratio of 2:1 is provided that reduces the stitch length by one half, which, in effect, doubles the stitch density.

BRIEF DESCRIPTION OF THE DRAWINGS

The above and other features of the invention may be understood on a review of the following detailed description read in connection with the figures in which.

DESCRIPTION OF THE PREFERRED EMBODIMENT

Figure 1:
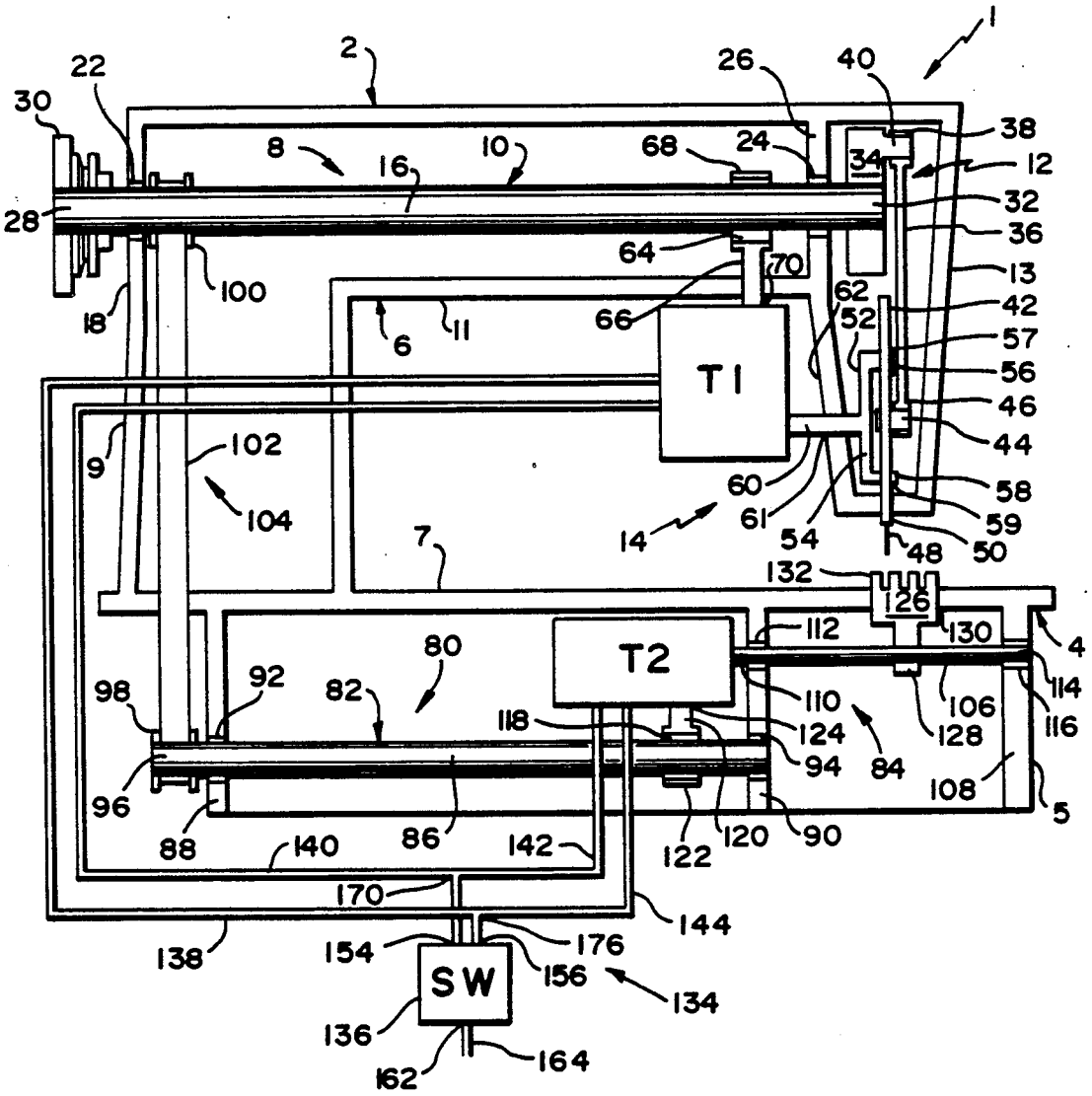
FIG. 1 is schematic, cutaway elevation view of a double lock stitch sewing machine including the apparatus of this invention.

A double lock stitch sewing machine of the Singer® 300W type including the apparatus in accordance with the invention is shown in schematic form in FIG. 1. As will be appreciated by those skilled in the art, a Singer 300W type double lock stitch machine is substantially more complex than as presented in FIG. 1. However, for the sake of charity, only the machine elements necessary for an understanding of the present invention have been illustrated. A more detailed understanding of a Singer 300W type machine, and the elements it includes can be had with reference to a parts list for the machine such as IPD 511-73, published by the Singer Company in 1973, the contents of which are incorporated herein by reference.

With regard to FIG. 1, as seen there, double lock stitch machine 1 includes a housing 2 having a base section 4 and an arm section 6. As shown, base section 4 includes a pedestal 5 defined by the section's lateral walls and a work table 7 constituted by the section's upper wall. Continuing, arm section 6 stands atop work table 7 and includes a support column 9 defined by the section's vertically extending walls, a beam 11 constituted by the section's laterally extending walls and a head 13 defined by the housing walls that terminate beam 11.

Internally of housing arm section 6, machine 1 includes a needle drive train mechanism 8 having an arm drive shaft assembly 10, a needle reciprocating assembly 12 and a needle rocking assembly 14. As shown, drive shaft assembly 10 includes a drive shaft 16 that extends longitudinally in arm section beam 11 from column 9 toward head 13. In this arrangement, shaft 16 is rotatably mounted in the housing journaled in bearing 22 located at housing power end 18 and in bearing 24 at housing internal vertical partition 26. Arm drive shaft assembly 10 is also seen to include a drive pulley 30 mounted on shaft 16 at first end 28, suitable for coupling shaft 16 to a power source such as an electric motor and drive belt, not shown.

At its second end 32, shaft 16 is connected to needle reciprocating assembly 12. Specifically, needle reciprocating assembly 12 includes a crank 34 mounted on end 32 of drive shaft 16. Additionally, needle reciprocating assembly 12 includes a connecting rod 36 having an upper end 38 attached to crank pin 40 of crank 34. Still further, needle reciprocating assembly 12 includes a needle bar 42 having a stud 44 affixed thereto approximately mid length of bar 42, stud 44 being further coupled to the lower end 46 of connecting rod 36. A sewing needle 48 is arranged axially extending from end 50 of needle bar 42.

Continuing with reference to FIG. 1, as noted needle drive train 8 also includes a needle rocking assembly 14. Rocking assembly 14 features a rocking frame 52 in the form of a yoke having a vertically disposed beam 54, and upper end piece 56 and a lower end piece 58. End pieces 56, 58 are provided with bores 57, 59, respectively, extending through end 56, 58 in a direction substantially parallel to the longitudinal axis of beam 54 for slidably receiving vertically disposed needle bar 42. In addition, rocking frame 52 includes needle rocking drive shaft 60 that extends orthogonally from beam 54 at a point between end pieces 56, 58 as shown, and is journaled for rotary movement in bore 61 at the lower inside wall 62 of housing head 13.

Additionally, needle rocking assembly 14 includes needle rocking eccentric 64 mounted on shaft 16 of arm drive shaft assembly 10 proximate internal partition 26. A connecting rod 66 is fitted over eccentric 64 at connecting rod first end 68. In accordance with the invention, a transmission T1 having a variable transmission ratio is connected in needle rocking assembly 14 at second end 70 of connecting rod 66 to couple rod 66 to needle rocking drive shaft 60.

In operation, when drive shaft 16 of needle drive train 8 is caused to rotate by application of power at pulley 30, crank 34 of needle reciprocation assembly 12 causes rod 36 to reciprocate needle bar 42 in rocking frame 52. Concurrently with the reciprocation of needle bar 42, eccentric 64 causes rod 66, and transmission T1 to provide oscillatory, rotary movement to rocking frame drive shaft 60. As a result of the oscillatory, rotary motion of drive shaft 60, frame 52 is caused to rock into and out of the plane of FIG. 1; i.e., in the direction of the machine stitches. Accordingly, and as a result of the reciprocating motion of needle bar 42 and rocking motion of frame 52, needle 48 is caused to travel in the traditional elliptical path required for double lock stitch sewing.

As is well known in the art, in accordance with traditional methods for forming double lock stitches, not only must the machine needle be moved in an elliptical path, but also, the machine feed dog must advance the fabric to be sewn in synchronization with the needle and the machine looper, not shown, the machine looper supplying and manipulating thread beneath the fabric to lock the needle thread in place as the needle penetrates and is withdrawn from the fabric being sewn.

In accordance with the design of the Singer 300W type machine, the mechanism for providing drive to the feed dog and looper is located in the machine housing base section 4. With reference to FIG. 1, housing base section pedestal 5 contains a feed dog and looper drive train mechanism 80 that includes a base drive shaft assembly 82, the machine feed dog assembly 84 and the machine looper assembly, the looper assembly, for simplicity, not being shown. As seen, base drive shaft assembly 82 includes a drive shaft 86 that extends laterally within pedestal from pedestal wall 88 at which power is available to vertical internal partition 90. In this arrangement, shaft 86 is rotatably mounted in pedestal 5 journaled in bearing 92 positioned at wall 88, and in bearing 94 position at internal partition 90. Base drive shaft assembly 82 also includes a pulley 98 mounted on shaft 86, at first end 96 for transmitting rotary power to shaft 86. As noted, operation of the Singer 300W type machine requires that action of the machine needle be synchronized with action of the machine feed dog and looper. To accomplish this, rotation of base drive shaft assembly 82 and arm drive assembly 10 are synchronized by coupling pulley 98 mounted on base drive shaft 86 to a pulley 100 provided as part of the arm drive shaft assembly 10, pulley 100 being on arm drive shaft 16 proximate drive pulley 30. A belt 102, typically of the toothed type, provides the coupling between pulleys 98, and 100 to form a belt-pulley drive assembly 104.

Continuing with reference to FIG. 1, feed and looper drive train 80 is seen also to include a feed dog assembly 84 located within pedestal 5 of housing base section 4. As shown, feed dog assembly 84 includes a feed dog drive shaft 106 that extends laterally from pedestal internal partition 90 to pedestal side wall 108. More specifically, shaft 106 is mounted in pedestal 5 journaled proximate end 110 in a bearing 112 provided at internal partition 90 and at end 114 in a bearing 116 provided at wall 108. Further, feed dog assembly 84 includes a feed dog drive eccentric 118 mounted on shaft 86 of base drive shaft assembly 82. In accordance with the invention, feed dog assembly 84 also includes a connecting rod 120 fitted over eccentric 118 at rod first end 122, and at its second end 124 rod 120 is connected to transmission T2 having a variable transmission ratio, T2 forming a still further element of feed dog assembly 84 in accordance with the invention. As shown, transmission T2 also receives and couples to feed dog drive shaft 106 at drive shaft end 110.

Continuing, feed dog assembly 84 further includes a feed dog element 126. Feed dog element 126 is mounted on shaft 106 at a first end 128 for oscillatory, rotary movement into and out of the plane of FIG. 1; i.e., in the machine stitch direction. As shown, element 126 projects upwardly through work table 7 at opening 130 of housing base section 4 where its fingers 132 are free to engage and advance fabric positioned on table 7 for sewing.

As is also well known in the art, in operation, movement of feed dog element 126 is actually compound, That is, in addition to movement in the stitch direction; i.e., into and out of the plane of FIG. 1, feed dog element 126 also moves up and down; i.e., in the vertical direction. The reason for this is that while movement of feed dog 126 in the stitch direction is required to synchronize movement of the fabric sewn with the movement of the machine needle, the vertical movement of feed dog element 126 serves to lift the fabric from work table 7 while the fabric is fed forward to assure a smooth advance during the stitch forming process. However, since the vertical movement of feed dog 126 is not of concern in determining stitch length, for simplicity, elements of the machine that control feed dog vertical movement have not been shown or discussed. For a more detailed understanding of those elements, reference may be had to the Singer parts manual above noted.

As is apparent from this description of machine elements and their relation, and as will be appreciated by those skilled in the art, stitch length in a Singer 300W type machine is determined by the amount of forward movement; i.e., movement in the stitch direction, given to needle 48 and feed dog 126, respectively, by the needle rocking assembly 14 and the feed dog assembly 84, between the point in time when needle 48 penetrates, is withdrawn from and again penetrates the fabric being sewn. That is to say, stitch length in this type machine is determined by the major axis of the elliptical movements of needle 48 and feed dog 126. And, as described above, the degree of movement imparted to needle 48 and feed dog 126 in the stitch direction is determined, respectively, by the action of eccentrics 64 and 118 as coupled to the needle rocking drive shaft 60 and the feed dog drive shaft 106.

In conventional Singer 300W type machines, the actions of eccentrics 64 and 118 are, respectively, coupled to needle rocking drive shaft 60 and feed dog drive shaft 106 by fixed length crank systems. Specifically, connecting rods 66 and 120, respectively, couple eccentrics 64 and 118 to a needle rocking crank and a feed dog crank (not shown) that directly rotate, in an oscillatory fashion, drive shaft 60, and 106. Therefore, in accordance with the design of a conventional Singer 300W type machine, the only way to adjust stitch length is to adjust the degree of movement in the stitch direction imparted to needle 48 and feed dog element 126 by adjusting the eccentricity of eccentrics 64 and 118.

However, to accomplish this, machine operation must first be interrupted so that a first detent pin (not shown) that extends from housing arm section 6 and is associated with needle rocking eccentric 64 can be manually depressed and rotated approximately a quarter of a turn to lock the detent in place and with it needle rocking eccentric 64. Thereafter, a second detent pin (not shown) that extends from housing base section 4 and is associated with feed dog eccentric 118 is depressed to also restrain eccentric 118. Next, rotation of drive pulley 30 must be undertaken to effect a simultaneous adjustment of the eccentricity of eccentrics 64 and 118, to thereby effect a change in stitch length. Finally, following adjustment of the eccentrics, the second detent is released and the first detent is again rotated to release it, thereby releasing eccentrics 64 and 118, and permitting the machine to return to operation. More particularly, where an increase in stitch length is desired, the eccentricity of eccentrics 64 and 118 must be increased by displacing the eccentrics relative to the longitudinal axis of their respective drive shafts; i.e., shaft 16 and shaft 86. This is accomplished by restraining the eccentrics as noted and simultaneously rotating their drive shafts with pulley 30. Where a decrease in stitch length is desired, the eccentricity of eccentrics 64 and 118 is decreased by moving the eccentrics toward alignment with the longitudinal axis of their respective drive shafts 16, 86, again by restraining the eccentrics and simultaneously rotating their drive shafts with pulley 30.

As previously discussed, double lock stitches have a tendency to unravel at the end of seams or lines of stitching. This tendency for unraveling at best causes unsightly products, and if allowed to progress, at worst produces defective seams and stitching. As can be appreciated such results are commercially undesirable.

While, as also noted, it has been suggested this tendency can b lessened if the stitch length used for the seam or stitching, is decreases at the end of the seam or line of stitching, the awkwardness and difficulty associated with changing stitch length in this type machine, as is readily apparent from the above description, renders such an approach commercially impractical.

However, the apparatus on this invention overcomes this shortcoming of the conventional Singer 300W type machine by making it possible to easily and quickly change machine stitch length dynamically; i.e., while the machine is in operation.

Particularly, in accordance with the invention, transmission T1 and T2, each having a variable transmission ratio are, respectively, inserted into the machine needle drive train mechanism 8 and machine feed dog and looper drive train mechanism 80. In preferred form, transmission T1 is inserted at the needle rocking assembly 14, between connecting rod 66 and needle rocking drive shaft 60; and transmission T2 is inserted in feed dog assembly 84 between connecting rod 120 and feed dog drive shaft 106 as shown in FIG. 1

Figure 2:
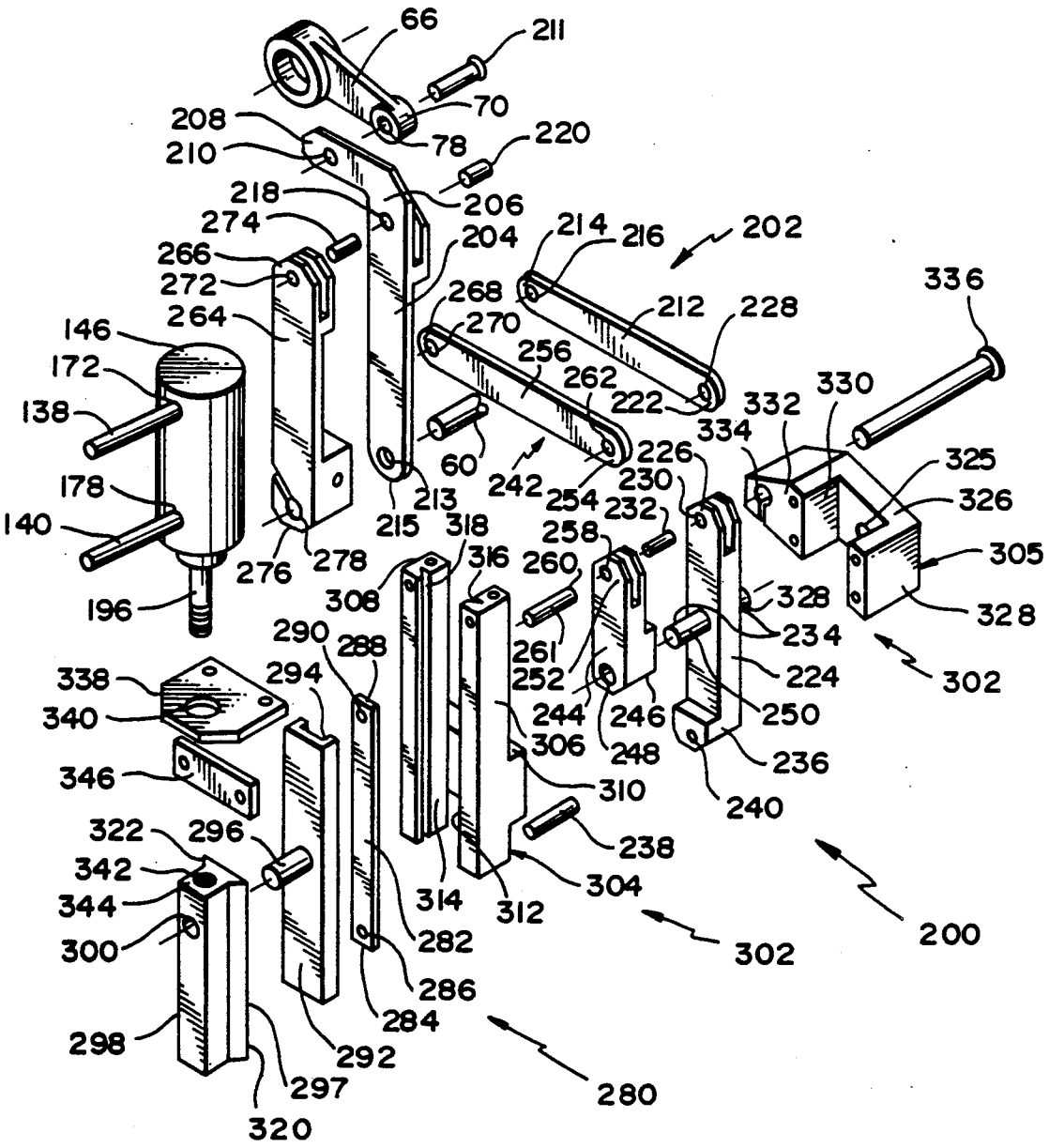
FIG. 2 is an exploded perspective view of the first transmission for coupling to the machine needle rocker drive line in accordance with the invention.

In accordance with the invention, a preferred form of the transmission for use in needle drive train 8 is shown in FIG. 2. As seen there, transmission T1 comprises a lever mechanism 200 having an input lever assembly 202, and output lever assembly 242, a coupling assembly 280 and a framework 302. With reference to FIG. 2, input lever assembly 202 is seen to be capable of being connected to end 70 of connecting rod 66 of the needle rocking assembly, rod 66 itself being connected to eccentric 64 as best seen in FIG. 1. As shown in FIG. 2, input lever assembly 202 includes a first lever element 204, a connecting link 212 and a transfer crank 224. In this arrangement, lever element 204 has a first end 206 including a coupling tab 208 for connecting input assembly 202 to end 70 of connecting rod 66 and rocking eccentric 64. As shown, tab 208 features a bore 210 for receiving a pin 211 that attaches rod 66 at bore 78 to tab 208. In this arrangement, bore 210 is dimensioned to provide an interference fit to pin 211, while bore 78 of rod 66 is made larger to permit motion. Additionally, proximate tab 208, lever 204 at end 206 is preferably formed with a clevis for receiving connecting link 212 at link end 214. At end 214, link 212 is provided with bore 216 that aligns with companion bores 218 provided in the clevis of lever 204, for receiving a pin 220. Clevis bores 218 are dimensioned to receive pin 220 with an interference fit to assure pin 220 will remain in place during machine operation, while link bore 216 is dimensioned to be larger to permit free movement of link 212 at pin 220.

As seen in FIG. 2, input lever 204 is also provided with a bore 213 at its second end 215. Bore 213 is provided to facilitate mounting lever 204 on rocking drive shaft 60. Here bore 213 is dimensioned larger than shaft 60 so that lever 204 is free to rotate on shaft 60, thus facilitating a convenient pivot for lever 204. Continuing with reference to FIG. 2, link 212 has a second end 222, at which link 212 is received in a transfer crank 224. Transfer crank 224 has a first end 226 also preferably formed as a clevis for receiving end 222 of link 212. End 222 of link 212 is provided with a bore 228 that aligns with companion bores 230 in the clevis of crank 224. Bores 230 are dimensioned to receive a pin 232 with an interference fit for the reasons noted above, while bore 228 is of larger dimension to permit movement.

Crank 224 further includes a pin 234 located at approximately mid length of crank 224 extending therethrough substantially parallel to the thickness axis of crank 224 as shown. In addition crank 224 has a second end 236 having a pin 238 extending from the outboard side; i.e., the side away from machine 1, which would be to the right in FIG. 2. As seen in FIG. 2, pin 238 is received and fixed in a bore 240 provided at lower outboard face of crank 224, and extends substantially orthogonally from that face.

In addition to input lever assembly 202, mechanism 200 also includes an output lever assembly 242, output lever assembly 242 including crank 244, link 256 and lever 264. As shown in FIG. 2, output assembly crank element 244 has a first end 246 in which a bore 248 is provided. Bore 248 is dimensioned to be rotationally received at outboard extending portion 250 of pin 234, pin portion 250, thereby, forming a pivot for crank 244.

Continuing with reference to FIG. 2, crank 244 has a second end 252 again formed as a clevis for receiving a link, particularly, end 254 of connecting link 256. As with input assembly link 212, output assembly link 256 is provided with a bore 262 a end 254 that aligns with bores 258 provided in the clevis of crank element 244. Once again, bores 258 are dimensioned to receive a pin 260 as an interference fit, while bore 262 of link 256 is dimensioned larger to permit freedom of rotational movement. However, here the length of pin 260 is selected to extend beyond the outboard side of the crank clevis to form a crank arm 261.

Output lever assembly 242 further includes an output lever 264 having a first end 266, once again formed as a clevis, in this case, for receiving end 268 of output link 256. Here also link end 268 is provided with a bore 270 that aligns with companion bores 272 in the clevis of lever element 264. As in the other clevis arrangements, bores 272 are dimensioned to receive a pin 274 as an interference fit, while bore 270 is dimensioned larger to permit free rotational movement. Still further, lever 264 has a second end 276 including a notched bore 278 that is dimensioned to be clamped to needle rocking drive shaft 60 for enabling lever 264 to rotate shaft 60.

In accordance with the invention, mechanism 200 also includes a coupling assembly 280 for coupling input lever assembly 202 to output lever assembly 242 so that the transmission ratio of T1 can be varied. More specifically, coupling assembly 280 includes a yoke element 282 in the form of a bar that couples the input assembly crank 224 to the output assembly crank 244. As seen in FIG. 2, yoke 282 has a first end 284 in which a bore 286 is provided for receiving arm 238 of input assembly crank 224. Additionally, yoke 282 has a second end 288 also including a bore, here designated 290, for receiving the arm 261 of output assembly crank 244.

Still further, coupling assembly 280 includes a translatable yoke pivot 292 for slidably receiving yoke 282. As shown, pivot 292 is provided with an open ended channel 294 that extends the length of the inboard face of pivot 292 and in which yoke 282 is slidably received. In addition, pivot 292 has a pin 296 located at approximately mid length of pivot 292 and extends substantially parallel to the thickness axis of input pivot 292 in the outboard direction to form an axis of rotation for pivot 292, its channel 294 and yoke 282 received therein. As seen in FIG. 2, and in accordance with the invention, yoke 282 is located in channel 294 and pin 296 is located on pivot 292 such that the axis of rotation always lies between the points at which the coupling assembly; particularly, yoke 282, connects to the input assembly crank and output assembly crank. Accordingly, input rotational motion supplied at crank 224 is coupled to output crank 244 by yoke 282 rotating about pin 296.

Continuing, coupling assembly 280 also includes a slider 298 having a bore 300 in its face 297 that extends through slider 298 substantially orthogonally to face 297 for rotatably receiving the pin 296 of pivot 292. In this arrangement, the length axis of slider 298, pivot 292 and yoke 282 are substantially parallel and pivot 292 together with yoke 282 are free to rotate in a plane perpendicular to pin 238 of the input assembly crank and pin 261 of the output assembly crank. Moreover, and in accordance with the invention, slider 298, and with it pivot 292, are free to translate in a direction perpendicular to crank element pins 238 and 261 of the input and output assemblies, respectively, such that the axis of rotation of pivot 292 may be shifted between the connection points of crank pins 238 and 261 at yoke 282.

Therefore, in accordance with the invention, the distance from the input assembly crank pin 238 to the coupling pivot; i.e., pin 296, and the distance from the output assembly crank pin 261 to the coupling pivot may be changed by translating slider 298. As will be appreciated by those skilled in the art, the change in relative distance of the input and output assembly crank pins from the axis of rotation of the pivot 292 facilitates change of the transmission ratio of T1. In accordance with the preferred form of the invention, in a first position of slider 298, the axis of rotation of pivot 292 is located midway between the point at which the input assembly crank pin 238 and output assembly crank pin 261 are connected to coupling yoke 282. As will be appreciated, this produces a transmission ratio for mechanism 200 of 1:1, the effective length of the input crank and output crank; i.e., the distance for the axis of rotation, being equal.

However, in a second position in accordance with the preferred form of the invention, slider 298 is translated so that the axis of rotation of pivot 292; i.e., pin 296, is drawn toward the point at which the output assembly crank pin 261 connects to yoke 282, and away from the point at which the input assembly crank pin 238 connects to yoke 282. This has the effect of reducing the magnitude of output assembly rotational movement for a given amount of input assembly rotational movement. Further, in preferred form, the movement of the axis of rotation of pivot 292 is selected such that the transmission ratio is reduced from 1:1 to 2:1, thereby reducing the machine stitch length by one half. As will be understood, this reduction in stitch length is realized where the transmission ratio of T2 is likewise reduced as will be explained more fully hereafter.

As shown in FIG. 2, lever mechanism 200 further includes a frame work 302 for mounting input assembly 202 output assembly 242 and coupling assembly 280. Specifically, framework 302 includes a first frame member 304 for mounting the coupling assembly 280 and a second framework member 305 for mounting input assembly 202 and output assembly 242 to frame member 304 and for mounting the entire framework to the machine housing 2. Specifically, frame member 304 includes a pair of vertically extending, opposing beams 306 and 308, laterally displaced from one another and fixed in position by a transverse brace 310 provided at the lower portions of the beams at their respective inboard sides. Beams 306 and 308 have opposing interior faces 312 and 314, respectively, each having longitudinally extending groves 316 and 318, respectively.

Groves 316 and 318 are provided at framework faces 312 and 314, respectively, to receive companion edges 320 and 322, respectively, of slider 298. As seen in FIG. 2, slider 298 is slidably mounted in framework member 304 together with pivot 292, the pin 296 of which is received in slider 298 at bore 300. As will be apparent, other arrangements for facilitating sliding movement could be used; e.g., rollers instead of grooves. As will also be appreciated, framework beams 306 and 308 are spaced laterally so that pivot 292 can sufficiently rotate to permit mechanism action.

Continuing, frame member 305 is formed as a generally "U" shaped end cap having an inboard wall 326, side walls 328, 330 and outboard mounting face 332. End wall 326 is provided with a bore 325 arranged orthogonally to wall 326 for receiving outwardly extending portion 328 of pin 234 and, with it, input assembly crank 224 attached thereto. Additionally, since output assembly crank 244 is rotationally mounted to pin portion 250 extending from crank 224, crank 244 is likewise mounted in end cap 305. In accordance with the design of mechanism 200, end cap 305 is mounted at its face 332 to brace 310 of framework section 304. While any convenient mounting technique could be employed, in preferred form, screws, not shown, are used, and extend through holes in end cap 305 seen in FIG. 2. Additionally, side wall 330 of end cap 305 is laterally extended to allow for a slotted bore 334 that is disposed substantially orthogonally to mounting face 332. A pin 336 extends into bore 334 and is received inboard of bore 334 at a mounting member, not shown, provided at machine housing 2 for mounting mechanism 200 to machine 1.

In this arrangement, walls 328 and 330 of end cap 305 are laterally spaced so that input assembly crank 224 and output assembly crank 244 are free to rotate in accordance with operation of mechanism 200. In addition, and as will be appreciated by those skilled in the art, in this arrangement, while yoke 282 is free to rotate, it is, however, fixed in its longitudinal direction. Accordingly, end cap 305 and crank pins 238 and 261 connect to yoke 282 are dimensioned to permit pivot 292 and slider 298 attached thereto to slide relative to yoke 282 received at pivot channel 294.

As seen in FIG. 2, framework member 304 also includes a mounting plate 338 attached to the upper ends of framework beams 306 and 308. Plate 338 attached to beams 306 and 308 in any convenient fashion, e.g., by screws, not shown, received in mounting holes provided in plate 338 and beams 306, 308 seen in FIG. 2. As shown, plate 338 includes a hole 340 through it for receiving and mounting pneumatic piston 146. Hole 340 is positioned relative to slider 298 such that piston rod 196 may be received in alignment with the longitudinal axis of slider 298 at bore 342 provided in end 344 of slider 298. Piston rod 196 may be affixed to slider 298 in any convenient manner; e.g., by threading rod 196, and screwing it into companion threads provided at bore 342 as shown. As will be appreciated, piston rod 196 provides the drive for translating slide 298 and pivot 292 to effect change of the mechanism transmission ratio as will be more fully described hereafter and in connection with the description of actuator 134 shown in FIG. 4.

Finally, a stop 346 is mounted at the upper ends of beams 306 and 308 proximate piston mounting plate 338. Stop 346 is a simple rectangular plate attached transversely to beams 306 and 308 and in position to interrupt translation of slider 298 toward the ends of the beams at which piston 146 is mounted. As will be appreciated, the width of stop 346; i.e., the distance it extends longitudinally along beams 306 and 308 from piston mounting plate 338, determines the distance the pivot pin can be translated toward output assembly crank pin 261 and, accordingly, the amount of reduction in transmission ratio that can be produced. As with the other components of mechanism 200, stop 346 can be attached to beams 306 and 308 in any convenient fashion; e.g., by screws, not shown, disposed through mounting holes seen in stop 346 and beams 306 and 308 shown in FIG. 2.

In operation, the reciprocating motion provided by needle rocking eccentric 64 and connecting rod 66 results in oscillatory motion of lever 204. In turn, rotation of lever 204 causes link 212 to be displaced. On displacement of link 212, input assembly crank 224 is caused to rotate about the axis defined by pin 234. Thereafter, rotation of crank 224 is transmitted by crank pin 238 to lower end 284 of yoke 282. Accordingly, yoke 282 carried in channel 294 of pivot 292 is caused to rotate about the axis defined by pivot pin 296, with the result that crank pin 261 connected at yoke end 290 is caused to rotate about the axis again defined by pivot pin 296. Rotation of pin 261, in turn, causes output assembly crank 244 to rotate on pin 250 thereby displacing link 256, causing output assembly lever 264 to rotate needle rocking drive shaft 60.

In a first position, slider 298 locates pivot pin 296 approximately mid way between input assembly crank pin 238 and output assembly crank 261, both connected to coupling assembly yoke 282, thereby producing a transmission ratio for mechanism 200 of 1:1. However, on activation of actuator 134,. its piston 146 translates slider 298 and pivot pin 296 toward output assembly crank pin 261 until slider 298 hits stop 346. In this second position, slider 298 locates pivot pin 296 closer to output assembly pin 261 than to input assembly pin 238, thus changing the effective length of the associated cranks and reducing the transmission ratio of the mechanism to less than 1. In the preferred form, the transmission ratio is reduced to approximately 2:1 which in turn reduces stitch length by a comparable amount, provided transmission T2 for the feed dog mechanism is reduced by a similar amount. As will be appreciated, other ratios either greater or less than one could be readily obtained within the range of pivot movement available between the contact points of the input and output element at the coupling yoke. All that is required is supply of the appropriate actuation; i.e., displacement of slider 298.

Figure 3:
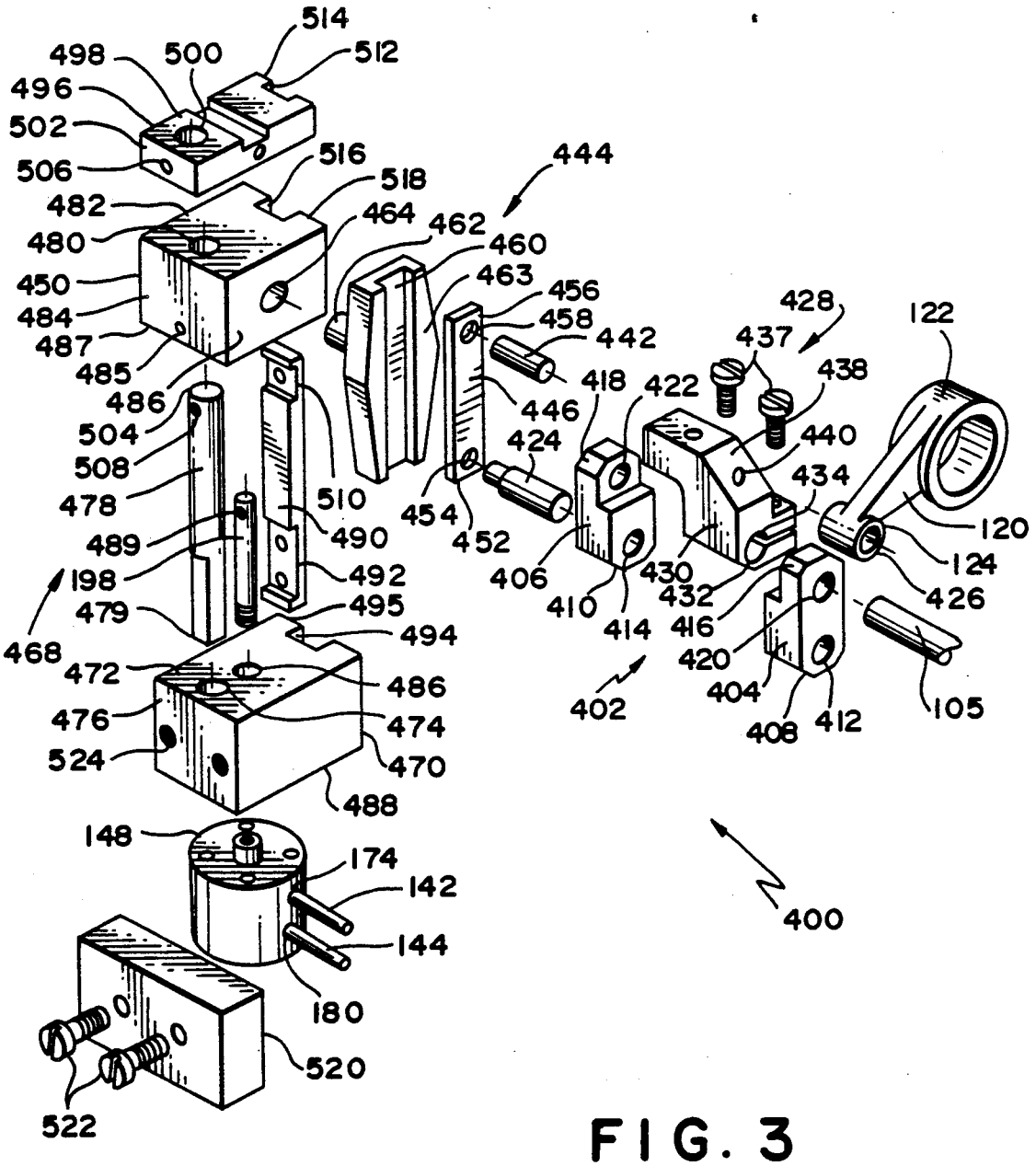
FIG. 3 is a exploded perspective view of the second transmission for coupling to the machine feed dog drive line in accordance with the invention.

Continuing, in accordance with the invention, a preferred form of transmission T2 for use in the feed dog and looper drive train 80 is presented in FIG. 3. In principle, T2 is the same as T1, and differs only in the form found preferable to accommodate the space constraints associated with the machine base. As seen in FIG. 3, transmission T2 comprises a lever mechanism, here designated 400, having an input lever assembly 402, and output lever assembly 428, a coupling assembly 444 and a framework 468. As shown input lever assembly 402 is seen to be capable of being attached to connecting rod 120 and eccentric 118 of feed dog assembly 84, as best seen in FIG. 1. More specifically, input assembly 402 includes a pair of lever elements 404 and 406 having lower ends 408 and 410, respectively, in which bores 412 and 414 are provided extending through the respective elements substantially parallel to their thickness axis as shown. Additionally, lever elements 404 and 406 have upper ends 416 and 418, respectively, in which bores 420 and 422 are provided extending through the respective elements substantially parallel to their thickness axis as shown.

Input assembly 402 also includes a pin 424 journaled in bores 414 and 412 of lever elements 406 and 404, and further received in bore 426 that extends through rod end 124 substantially parallel to the thickness axis of rod 120 for connecting lever assembly 402 to rod 120. Still further, lever elements 404 and 406 are rotatably received on feed dog drive shaft 106 at lever element bores 420 and 422, respectively.

Mechanism 400 also includes an output lever assembly 428. Output assembly 428 features a lever element 430 having a lower end 432 at which a slotted bore 434 is provided extending through element 430 substantially parallel to its thickness axis as shown. Lever 430 is received on feed dog drive shaft 106 at bore 434, lever 430 being disposed between upper ends 418 and 420 of input assembly lever elements 404 and 406. Output assembly element 430 is also provided with screws 437 arranged orthogonally to the slot of bore 434 to clamp element 430 to feed dog drive shaft 106. At its upper end 438, lever 430 is provided with a bore 440 that extends through element 430 substantially parallel to the thickness axis of element 430. As shown, pin 442 is fixed in bore 440.

As seen in FIG. 3, and in accordance with the invention, mechanism 400 also includes a coupling assembly 444 for coupling input lever assembly 402 to output lever assembly 428 so that the transmission ratio of T2 can be varied. More specifically, coupling assembly 444 includes a yoke 446, a translatable pivot 448 and a slider 450. As shown, yoke element 446 is in the form of a bar that couples the input assembly lever pin 424 to the output assembly lever pin 442. Particularly, yoke 446 has a first end 452 in which a bore 454 is provided for receiving pin 424 of input assembly 402. As shown, pin 424 has a reduced diameter where it connects to yoke 446, the diameter of pin 424 being sized at the remainder of its length to fit bore 426 of connecting rod 120. Additionally, yoke 446 has a second end 456 also including a bore, here designated 458, for receiving pin 442 of output assembly lever 430.

Coupling assembly 444 also includes a translatable yoke pivot 448 for slidably receiving yoke 446. As shown, pivot 448 is provided with an open ended channel 460 that extends the length of the face 463 of pivot 448 and in which yoke 446 is slidably received. In addition, pivot 448 has a pin 462 located at approximately mid length of pivot 448 and extends in a direction away from feed dog drive shaft 106, and substantially parallel to the thickness axis of pivot 448, to form an axis of rotation for pivot 448, its channel 460 and yoke 446 received therein. As seen in FIG. 3, and in accordance with the invention, yoke 446 is located in channel 460 and pin 462 is located on pivot 448 such that the axis of rotation always lies between the points at which the coupling assembly, and specifically, yoke 446 connects to the input assembly lever pin 424 and output assembly lever pin 442. Accordingly, input rotational motion supplied at lever elements 404 an 406 is coupled to output lever 430 by yoke 446 rotating about pin 462.

Still further, coupling assembly 444 also includes a slider 450 having a bore 464 in its face 466 that extends into slider 450 substantially orthogonally to face 466 for rotatably receiving the pin 462 of pivot 448. In this arrangement, the length axis of slider 450, pivot 448 and yoke 446 are substantially parallel and pivot 448 together with yoke 446 are free to rotate in a plane perpendicular to pin 424 of the input assembly and pin 442 of the output assembly. Moreover, and in accordance with the invention, slider 450 and with it pivot 448 are free to translate in a direction perpendicular to pins 424 and 442 of the input and output assemblies, respectively, such that the axis of rotation of pivot 448 may be shifted between the points of connection of the input and output assembly pins 424 and 442 to yoke 446.

Therefore, in accordance with the invention, the distance from the input assembly pin 424 to the coupling pivot pin 462; i.e., the axis of rotation, and the distance from the output assembly pin 442 to the coupling pivot pin 462 may be changed by translating slider 450. As will be appreciated by those skilled in the art, the change in relative distance of the input and output assembly pins 424, 442, respectively, from the axis of rotation of the pivot 448 facilitates change of the transmission ratio of T2. In accordance with the preferred form of the invention, in a first position of slider 450, the axis of rotation of pivot 448 is located mid way between the point at which the input assembly pin 424 and output assembly pin 442 connect to coupling yoke 448. As will be appreciated, this produces a transmission ratio for mechanism 400 of 1:1, the effective length of the input and output levers; i.e., the distance for the axis of rotation, being equal.

However, in a second position in accordance with the preferred from of the invention, slider 450 is translated so that the axis of rotation of pivot 448; i.e., pin 462, is drawn toward the point at which the output assembly pin 442 connects to yoke 446, and away from the point at which the input assembly crank pin 424 connects to yoke 446. This has the effect of reducing the magnitude of output assembly rotational movement for a given amount of input assembly rotational movement.

In preferred form the movement of the axis of rotation of pivot 448 is selected such that the transmission ratio is reduced for 1:1 to 2:1, thereby reducing the machine stitch length by one half. As will be understood, this reduction in stitch length is realized where the transmission ratio of T1 is similarly set, it being necessary for proper operation of machine 1 that the amount of movement provided by the machine rocking mechanism to the needle be coordinated with the amount of movement provided by the machine feed dog mechanism to the feed dog.

As seen in FIG. 3, lever mechanism 400 further includes a frame work 468 for mounting the input assembly 402, output assembly 428 and coupling assembly 444. Particularly, framework 468 includes a mounting block 470 having upper face 472 in which a bore 474 is provided proximate block end face 476. Bore 474 extends into block 470 in a direction substantially perpendicular to face 472, and is dimensioned to receive a slide shaft 478 in interference fit. Slide 450 is provided with a similar bore 480, in face 482, proximate slider end face 484, bore 480 extending through slider 450, substantially orthogonally to face 482. Slider bore 480 however, is dimensioned with a larger diameter, to permit free movement over shaft 478.

Continuing, mounting block 470 further includes a bore 486 located centrally of upper face 472 that extends through block 470 substantially perpendicularly to face 472. Bore 486 is dimensioned to freely receive piston shaft 198 of pneumatic piston 148 which is mounted centrally of bore 486 in conventional fashion, not shown, at the underside 488 of mounting block 470. In accordance with the invention, piston rod 198 is attached to slider 450 in any convenient fashion; e.g., by a screw not shown inserted into bore 485 at slider face 484 that communicates with bore 480 which extends to the lower face 487 of slider 450. With such an arrangement, the screw at bore 485 would be received in threaded bore 489 provided at the end of piston rod 198 orthogonally to its length axis to anchor the rod in slider 450.

Continuing, framework 468 also includes a guide beam 490 having a lower end portion 492 cutaway to be received in a companion recess 494 provided in mounting face 495 of block 470. Beam 490 may be attached to block 470 in any convenient fashion; e.g., by screws, not shown, provided in the mounting holes seen in beam lower end portion 492 in FIG. 3. Still further, frame 468 includes an end stop 496 for constricting the travel of slider 450 on slide shaft 478 under the action of pneumatic piston. Stop 496 is provided with an upper face 498 in which a bore 500 is provided proximate stop end wall 502. Bore 500 extends through stop 496 in a direction substantially perpendicular to face 498, and is dimensioned to receive end 504 of shaft 478. Stop 496 is fastened to end 504 of shaft 478 in any convenient fashion; e.g., by screws provided in bore 506 at stop end face 502 that communicate with bore 500 of stop 496. In this arrangement a screw, not shown, received through bore 506 can be combined with a threaded bore 508 provided at end 504 of shaft 478.

Still further, beam 490 is provided with an upper cutaway end 510 that may be received in a companion recess 512 provided in side wall 514 of stop 496. End 510 may be attached to stop 496 again in any convenient manner; e.g., by a screw, not shown, received in mounting hole provided in beam 490 and threaded bore provided at recess 512 of stop 496. As is also apparent from FIG. 3, slider 450 is provided with a recessed guide way 516 in side wall 518 to cooperate with the profile of beam 490 as slider 450 is translated along shaft 478 by piston 148 as will be further described hereafter.

Finally, block 470 is mounted at face 476 to machine housing 2, specifically, at the wall of housing pedestal 5 represented in FIG. 3 by section 520, as for example, by screws 522 as shown, or in any other convenient fashion to thereby mount mechanism 400 and piston 148 to machine 1.

In operation, reciprocating motion provided by eccentric 118 and connecting rod 120 is communicated to input assembly pin 424 and lever elements 404 and 406. As a result, pin 424 is caused to rotate about feed dog drive shaft 106. In turn, rotation of pin 424 is transmitted to lower end 452 of yoke 446. Accordingly, yoke 446 carried in channel 460 of pivot 448 is caused to rotate about the axis defined by pivot pin 462, with the result that pin 442 connected at yoke end 456 is caused to rotate about the axis again defined by pivot pin 462. Rotation of pin 442, in turn, causes output assembly lever 430 to rotate and with it feed dog drive shaft fixed to it.

In a first position, slider 450 locates pivot pin 462 approximately mid way between the points at which input assembly pin 424 and output assembly pin 442 connect to coupling assembly yoke 446. This produces a transmission ratio for mechanism 400 of 1:1. However, on activation of the actuator 134, piston 148, translates slider 450 and pivot pin 462 toward output assembly pin 442 until slider 450 hits stop 496. In the second position, slider 450 locates the pivot point closer to output assembly pin 442 than to input pin 424, thus changing the effective length of the levers and reducing the transmission ratio of mechanism 400 to less that 1:1. In preferred form, the transmission ratio is reduced to 2:1 to reduce the stitch length by a comparable amount; i.e., by one half, as explained, provided the transmission ratio of T1 is reduced by a similar amount. As in the case of T1, other ratios for T2 could be attained if desired; e.g., greater or less than one, subject to the constraints of movement above noted.

It should be pointed out that while in transmission T1 pneumatic piston 146 withdraws its piston rod to establish the reduced transmission ratio position, in transmission T2, pneumatic piston 148 extends its piston rod 198 to establish the reduced transmission ratio position. As will be appreciated by those skilled in the art, such a result is readily achieved by appropriate connection of the actuator feed lines to the respective pistons as will be discussed in more detail hereafter.

Figure 4:
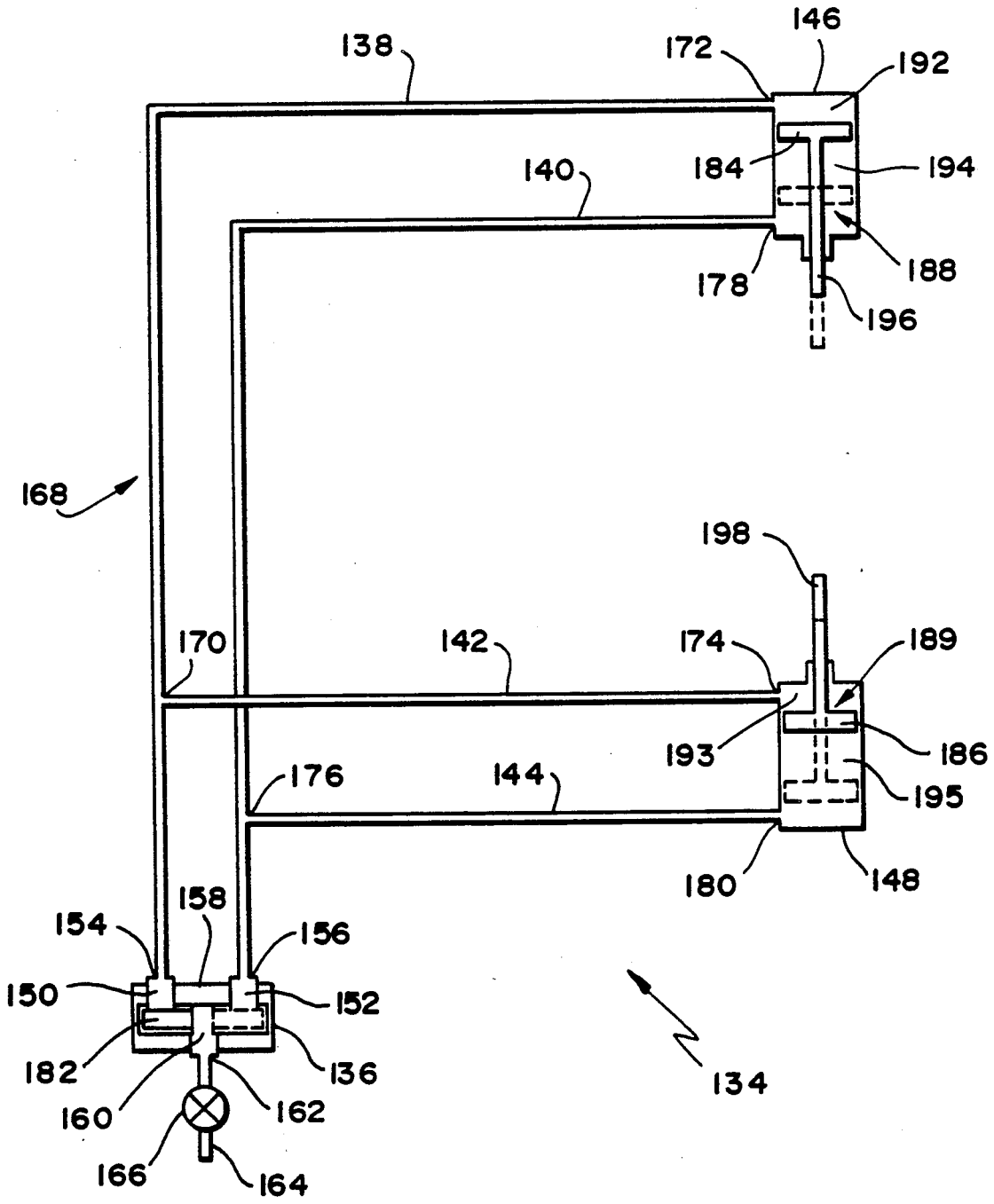
FIG. 4 is a schematic view of the pneumatic actuator of the apparatus in accordance with the invention.

In accordance with the invention, to achieve desired stitch length control, transmission mechanisms T1 and T2 are combined with an actuator 134 that facilitates synchronized change of their transmission ratios. As shown in FIG. 4, actuator 134 in preferred form is pneumatic and includes a pneumatic switch 136, a network 168 of pneumatic feed lines 138, 140, 142 and 144 for driving bi-directional pneumatic pistons 146 and 148, pistons 146 and 148 being mechanically connected, respectively, to transmission T1 and T2 as best seen in FIGS. 2 and 3. More specifically, actuator 134 includes a conventional, two-position pneumatic switch 136. As seen in FIG. 4, switch 136 has two feed channels, 150 and 152 that respectively pneumatically couple switch feed port 154 and 156 with a distribution chamber 158. Chamber 158 is also coupled to a pneumatic source, not shown, by pneumatic supply channel 160, the source being connected by a source supply line 164 to supply port 162 of channel 160. A valve 166 may be placed in source line 164 to facilitate control of pneumatic supply to switch 136.

Continuing, actuator 134 further includes a network of feed lines 168 for coupling the pneumatic source from switch 136 to pistons 146 and 148. Specifically, network 168 includes feed lines 138 and 142 connected together at junction 170 and to switch 136 at feed port 154. Further, feed line 138 and 142 are additionally respectively connected to first ports 172 and 174 of pneumatic pistons 146 and 148. Additionally, network 168 includes feed lines 140 and 144 connected together at junction 176 and to switch 136 at feed port 156. As shown, lines 140 and 144 are, respectively connected to ports 178 and 180 of pistons 146 and 148. As seen in FIG. 4, the feed ports are connected to different ports of the respective pistons. This is done to effect different movement directions for the respective pistons to accommodate limitations caused by the machine housing layout.

Actuator 134 still further includes pneumatic pistons 146 and 148. As seen in FIG. 4, in preferred form, pistons 146 and 148 are of the conventional bi-directional type, each having a double-sided piston element 184, 186 located respectively in piston cylinders 188, 189 so as to divide the cylinders into first chambers 192, 193, respectively, in communication with feed ports 172, 174, and second chambers, 194, 195 in communication with piston feed ports 178, 180 respectively. Additionally, each of the piston elements 184, 186 are provided with piston rods, 196 and 198, respectively. As will be appreciated, piston rods 196 and 198 communicate movement of elements 184 and 186 to the apparatus to be actuated that is connected to the piston rods; i.e., transmissions T1 and T2, respectively.

Continuing, and as seen in FIG. 4, switch 136 also includes a distribution shuttle 182 disposed in chamber 158. As will be appreciated, shuttle 182 is controlled in any convenient manner; e.g., by hand or foot operated mechanical lever, or solenoids, etc. In conventional pneumatic switch fashion shuttle 182 may be located in a first position, illustrated in FIG. 4 by dashed lines, such that it interrupts pneumatic communication between source supply line 164, channel 152 and feed lines 140, 144, while at the same time establishing pneumatic communication between source supply line 164, channel 150 and feed line 138, 142. As a result, chamber 192 of piston 146 and chamber 193 of piston 148 are pressurized forcing the piston element in piston 146 to have the extended position and the piston element in piston 148 to have the withdrawn position, both of which are illustrated in FIG. 4 by the dashed line form of the piston elements and rods.

Alternatively, if switch distribution shuttle is located in the second position illustrated in FIG. 4 by the solid lines, shuttle 182 interrupts communication between pneumatic source supply 164, channel 150 and feed line 138 and 142, while at the same time establishing pneumatic communication between source supply line 164, channel 152 and feed line 140, 144. The attendant result is that piston chamber 188 of piston 146 and piston chamber 195 of piston 148 are pressurized by the pneumatic source, and, accordingly, the piston element of piston 146 is withdrawn, while the piston element of piston 148 is extended. This position is illustrated in FIG. 4 by the solid line representation of the piston elements and rods.

As will be appreciated by those skilled in the art, the amount of travel provided and the respective directions can be readily controlled. As discussed in connection with the description of the transmission mechanisms, stops can be applied to interrupt the travel of the piston rod, and in turn, to control the placement of the coupling pivot's axis of rotation to thereby vary the amount of transmission ratio change. Accordingly, while the pneumatic actuator of the preferred embodiment has two positions corresponding to the two positions of the actuator switch, those two positions can be indexed with multiple fixed or adjustable stops to produce a series of stepped movements for the pistons. For example, if a stop having graduated steps was arranged to be either manually or automatically withdrawn from or inserted into the path of travel of piston rods 196 and 198, a series of transmission ratios corresponding to the steps could be realized. It can also be seen from the piston feed line connections in the preferred embodiment, that if for any reason it is desired to change the direction of piston travel to accommodate physical restrictions in a particular application, feed line connection to the piston chamber can be changed without affecting operation of the pistons or the transmissions.

As will also be appreciated by those skilled in the art, while for the sake of cost and reliability the preferred embodiment of the apparatus of the invention incorporates use of the described two position pneumatic actuator, other actuator type could be used. For example, the described mechanism would readily operate with a solenoid actuator, stepper motor actuator or continuous drive arrangements.

While I have described my invention in preferred form, it will be appreciated by those skilled in the art that various changes in form, construction and arrangements of its elements may be made without departing from the spirit or scope of the invention.

What I claim is:

1. Apparatus for use in a double lock stitch sewing machine, the apparatus for changing the machine stitch length during operation, the machine including a needle reciprocating assembly, a needle rocking assembly, a feed dog assembly, a first drive shaft assembly for driving the needle reciprocating assembly and needle rocking assembly, and a second drive shaft assembly for driving the feed dog assembly, the needle rocking assembly including a needle rocking eccentric, a needle rocking drive shaft and a connecting rod coupled to the needle rocking eccentric, and the feed dog assembly including a feed dog eccentric, a feed dog drive shaft and a connecting rod coupled to the feed dog eccentric, the apparatus further comprising:

a) a first transmission having a variable transmission ratio, the first transmission including input lever means, output lever means and means for coupling the first transmission input lever means to the first transmission output lever means, the first transmission input lever means being coupled to the needle rocking eccentric connecting rod, and the first transmission output lever means being coupled to the needle rocking drive shaft for controlling needle rocking movement;

b) a second transmission having a variable transmission ratio, the second transmission including input lever means, output lever means and means for coupling the second transmission input lever means to the second transmission output lever means, the second transmission input lever means being coupled to the feed dog eccentric connecting rod, and the second transmission output leaver means being coupled to the feed dog drive shaft for controlling feed dog movement; and c) an actuator means having at least a first actuator position and a second actuator position, the actuator means being coupled to the first and second transmission so that when the actuator means is in the first position the first and second transmission each have a first transmission ratio for producing a first machine stitch length, and when the actuator means is in the second position, the first and second transmission means each have a second transmission ratio for producing a second stitch length different from the first.

2. The apparatus of claim 1, wherein the transmission ratio of the first transmission and the transmission ratio of the second transmission are asynchronously changed when the actuator position of the actuator means is changed during machine operation.

3. The apparatus of claim 2 wherein the coupling means of the first and second transmissions are movable and connected to their respective input and output lever means at first and second points, and wherein each of the coupling means has an axis of rotation located between their respective first and second connecting points so as to define an effective length for the respective input and output lever means, the axis of rotation of the coupling means being movable relative to the connecting points so that the effective length of the respective input and output lever means may be varied to vary the transmission ratio of the respective transmissions.

4. The apparatus of claim 3 wherein the actuator means includes a first pneumatic piston connected to the first transmission and a second pneumatic piston connected to the second transmission.

5. The apparatus of claim 4 wherein the actuator means first pneumatic piston is connected to the coupling means of the first transmission and the actuator means second pneumatic piston is connected to the coupling means of the second transmission.

6. The apparatus of claim 5 wherein the actuator means includes a switch means having a first position that connects a pneumatic source to both the first and second pistons to establish the first actuator position, the switch means also having a second position that couples the pneumatic source to both the first and second pistons to establish the second actuator position.

7. The apparatus of claim 6 wherein the actuator means includes pneumatic feed lines that extend from the actuator means switch to the first and second pistons such that in the first actuator position the pneumatic source is connected to a first side of the respective pneumatic pistons and when the pneumatic actuator is in the second position, the pneumatic source is coupled to a second side of the respective pneumatic pistons

8. The apparatus of claim 7 wherein the respective transmissions further include stop means that may be disposed relative to the respective coupling means to define locations to which the respective pistons can set the respective coupling means in order to adjust the transmission ratios of the respective transmissions and the corresponding stitch length of the machine.

9. In a double lock stitch sewing machine having a needle reciprocating assembly, a needle rocking assembly, a feed dog assembly; a first drive shaft assembly for driving the needle reciprocating assembly and needle rocking assembly, and a second drive shaft assembly for driving the feed dog assembly, the improvement comprising inclusion of apparatus for enabling change of the machine stitch length while the machine is in operation, the apparatus further comprising:

a) a first transmission having a variable transmission ratio, the first transmission including a lever mechanism so that the first transmission may be connected to the needle rocking assembly for varying needle rocking movement;

b) a second transmission having a variable transmission ratio, the second transmission including a lever mechanism so that the second transmission may be connected to the feed dog assembly for varying the feed dog movement; and c) an actuator including switching means for establishing at least a first and a second indexed actuator position, the actuator means being connected to the first and second transmissions such that operation of the actuator switching means provides stepped change of the transmission ratio for the first and second transmissions so that in the first indexed position, the first and second transmissions each have a first transmission ratio that produce a first machine stitch length, and that when the actuator means is in the second indexed position, the first and second transmissions each have a second transmission ratio that produce a second stitch length different from the first, the actuator being further arranged such that when the actuator position is step-wise changed during machine operation the transmission ratio of the first and second transmission means are changed in synchronism so that the machine stitch length may be step-wise changed as desired.

10. The improved double lock stitch sewing machine of claim 9 wherein the needle rocking assembly includes a needle rocking eccentric and a needle rocking drive shaft, and the feed dog assembly includes a feed dog eccentric and a feed dog drive shaft, and wherein the lever mechanism of the first and second transmissions each include an input lever means and an output lever means, and further, wherein the input lever means of the first transmission is coupled to the needle rocking eccentric and the output lever means of the first transmission is coupled to the needle rocking drive shaft, and wherein the input lever means of the second transmission is connected to the feed dog eccentric and the output lever means of the second transmission is coupled to the feed dog drive shaft.

11. The improved double lock stitch sewing machine of claim 10 wherein the first and second transmissions each include a movable coupling means connected to the respective input and output lever means at first and second points, and wherein each of the coupling means has an axis of rotation located between the respective first and second connecting points so as to define an effective length for the respective input and output lever means, and wherein the axis of rotation of the coupling means may be moved relative to the connecting points so that the effective length of the respective input and output lever means may be varied to vary the transmission ratio of the respective transmissions.

12. The improved lock stitch sewing machine of claim 11 wherein the actuator means includes a first pneumatic piston connected to the first transmission and a second pneumatic piston connected to the second transmission, and wherein the actuator means first pneumatic piston is connected to the coupling means of the first transmission and the actuator means second pneumatic piston is connected to the coupling means of the second transmission.

13. The improved double lock stitch sewing machine of claim 12 wherein the actuator means includes a switch means having a first position that connects a pneumatic source to both the first and second pistons to establish the first actuator position, the switch means also having a second position that couples the pneumatic source to both the first and second piston to establish the second actuator position, and wherein the actuator means includes pneumatic feed lines that extend from the actuator means switch to the first and second pistons such that in the first actuator position the pneumatic source is connected to a first side of the respective pneumatic pistons and when the pneumatic actuator is in the second position, the pneumatic source is coupled to a second side of the respective pneumatic pistons so that when the position of the pneumatic actuator is changed during machine operation, the transmissions are shifted between positions that establish the first and second transmission ratios and associated machine stitch lengths.

14. The improved double lock stitch sewing machine of claim 13 wherein the respective transmissions further include stop means that may be disposed relative to the respective coupling means to define the second positions to which the respective pistons can set the respective coupling means in order to adjust the second transmission ratio of the respective transmissions and the corresponding second stitch length of the machine.

15. Apparatus for use in a sewing machine having one or more component assemblies including a reciprocating drive element and a drive shaft for generating component movement, the apparatus comprising:

a transmission having a variable transmission ratio, the transmission including an input lever means that may be coupled to the component reciprocating drive element and an output lever means that may be coupled to the component drive shaft, the transmission further includes a movable coupling means connected to the input lever means at a first point and connected to the output lever means at a second point, the coupling means having an axis of rotation located between the first and second connecting points such that the axis of rotation of the coupling means may be moved relative to the connecting points so that the effective length of the respective input and output lever means may be varied to vary the transmission ratio, and with it the amount of movement provided to the component; and an actuator means having at least a first and second actuator position, the actuator means being connected to the transmission so that when the actuator means is in the first position, the transmissions has a first transmission ratio that produces a first component movement, and that when the actuator means is in the second position, the transmissions has a second transmission ratio that produces a second component movement different in degree from the first.

16. The apparatus of claim 15 wherein the actuator means includes a pneumatic piston connected to the coupling means of the transmission to control movement of the coupling means.

17. The apparatus of claim 16 wherein the actuator means includes a switch means having a first position that connects a pneumatic source to the piston to establish the first actuator position, the switch means also having a second position that couples the pneumatic source to the piston to establish the second actuator position, the actuator means including pneumatic feed lines that extend from the actuator means switch to the piston such that in the first actuator position the pneumatic source is connected to a first side of the pneumatic pistons and when the pneumatic actuator is in the second position, the pneumatic source is coupled to a second side of the respective pneumatic pistons.

18. The apparatus of claim 17 wherein the transmission further includes stop means that may be disposed relative to the coupling means to define locations to which the piston can set the coupling means when the actuator is in the second position in order to adjust the second transmission ratio of the transmission and the corresponding second degree of movement permitted for the machine component.

* * * * *